US010276283B2

(12) United States Patent
Nabeta et al.

(10) Patent No.: US 10,276,283 B2
(45) Date of Patent: Apr. 30, 2019

(54) MANUFACTURING METHOD FOR TERMINAL-EQUIPPED ELECTRIC WIRE

(71) Applicant: YAZAKI CORPORATION, Tokyo (JP)

(72) Inventors: Yasunori Nabeta, Shizuoka (JP); Naoki Ito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/853,813

(22) Filed: Dec. 24, 2017

(65) Prior Publication Data

US 2018/0197660 A1 Jul. 12, 2018

(30) Foreign Application Priority Data

Jan. 12, 2017 (JP) ..... 2017-003457

(51) Int. Cl.
*H01B 13/00* (2006.01)
*H01B 5/08* (2006.01)
(Continued)

(52) U.S. Cl.
CPC ..... *H01B 13/00* (2013.01); *H01B 5/08* (2013.01); *H01R 4/625* (2013.01);
(Continued)

(58) Field of Classification Search
CPC ..... H01B 13/0006; H01B 13/00; H01B 13/0036; H01B 13/0023; H01B 5/08; H01R 4/029; H01R 43/0207
See application file for complete search history.

(56) References Cited

U.S. PATENT DOCUMENTS 8,118,209 B2 * 2/2012 Ohnuma ..... H01R 43/0207 228/110.1
9,550,252 B2 * 1/2017 Takayashiki ..... H01R 4/023
(Continued)

FOREIGN PATENT DOCUMENTS

JP 2009-231079 A 10/2009
JP 2011-82127 A 4/2011
(Continued)

OTHER PUBLICATIONS

Japanese Office Action for the related Japanese Patent Application No. 2017-003457 dated Feb. 26, 2019.

*Primary Examiner* — A. Dexter Tugbang
*Assistant Examiner* — Jeffrey T Carley
(74) *Attorney, Agent, or Firm* — Kenealy Vaidya LLP

(57) ABSTRACT

A manufacturing method for a terminal-equipped electric wire in which a terminal is crimped to an electric wire including a core wire bundle bundled by a plurality of conductor core wires, the manufacturing method includes ultrasonically bonding the core wire bundle so as to form a bonded core wire in which the plurality of conductor core wires are bonded to each other and crimping the terminal to the bonded core wire. The bonded core wire is formed so that a clearance ratio which is a percentage of a clearance area in which the conductor core wires do not exist to a whole area surrounded by an outer periphery of the bonded core wire is larger than 3 and equal to or less than 15 in a section view orthogonal to an axis of the bonded core wire.

4 Claims, 10 Drawing Sheets

(51) Int. Cl.

| | |
|---|---|
| ***H01R 4/62*** | (2006.01) |
| ***H01R 43/02*** | (2006.01) |
| ***H01R 43/048*** | (2006.01) |
| ***H01R 43/28*** | (2006.01) |
| *H01R 4/18* | (2006.01) |

(52) U.S. Cl.
CPC ..... *H01R 43/0207* (2013.01); *H01R 43/048* (2013.01); *H01R 43/28* (2013.01); *H01R 4/185* (2013.01); *H01R 4/62* (2013.01)

(56) References Cited

U.S. PATENT DOCUMENTS

2003/0226823 A1* 12/2003 Fujimoto ..... B23H 11/006 219/56.1
2004/0088857 A1* 5/2004 Fujimoto ..... H01R 11/12 29/871
2008/0032569 A1* 2/2008 Steiner ..... B23K 20/10 439/874
2009/0211783 A1* 8/2009 Tsutsumi ..... H01J 1/02 174/126.1
2010/0170935 A1* 7/2010 Stroh ..... B23K 20/10 228/110.1
2011/0094797 A1* 4/2011 Otsuka ..... H01R 43/0207 174/84 C
2011/0220385 A1* 9/2011 Lietz ..... B23K 20/10 174/90
2013/0000949 A1* 1/2013 Torimoto ..... B23K 20/10 174/113 R
2013/0025935 A1 1/2013 Takayama et al.
2014/0284099 A1* 9/2014 Saito ..... H01B 7/2825 174/70 R

FOREIGN PATENT DOCUMENTS

JP 2011-222311 A 11/2011
JP 2016-115525 A 6/2016

* cited by examiner

MANUFACTURING METHOD FOR TERMINAL-EQUIPPED ELECTRIC WIRE

CROSS REFERENCE TO RELATED APPLICATIONS

This application claims priority from Japanese Patent Application No. 2017-003457 filed on Jan. 12, 2017, the entire contents of which are incorporated herein by reference.

BACKGROUND OF THE INVENTION

Field of the Invention

The invention relates to a manufacturing method for a terminal-equipped electric wire comprising an electric wire having a core wire bundle composed of a plurality of bundled conductor core wires and a terminal crimped to the electric wire.

Description of Related Art

Conventionally, from the viewpoint of increasing the bending strength of an electric wire while enhancing the allowable current thereof, an electric wire having a core wire bundle composed of a plurality of bundled conductor core wires (for example, a stranded wire) has been proposed. In the case that a terminal is crimped to such type of core wire bundle (stranded wire), although conductor core wires situated in the outer peripheral part of the core wire bundle are contacted directly with the terminal and are thereby electrically connected thereto, conductor wires situated in the central part of the core wire bundle are electrically connected to the terminal through conductors situated in the outer peripheral part of the core wire bundle. Therefore, in order to enhance the overall conductivity between the core wire bundle and terminal, preferably, n addition to the conductivity between the conductor core wire and terminal (the conductivity of the outer peripheral part), the conductivity between the conductor core wires (the conductivity of the central part) may be enhanced.

On the other hand, recently, in some cases, aluminum, aluminum alloy or the like is used as the material of the conductor core wire because it is lighter and less expensive than copper. In this case, however, because an oxide film (aluminum oxide) naturally formed on the conductor core wire has a high insulation property, a device for enhancing the above-mentioned conductivity (the conductivity of the outer peripheral part and the conductivity of the central part) is particularly required.

Thus, for example, in one of conventional methods for manufacturing a terminal-equipped electric wire (which is hereinafter called the conventional manufacturing method), by ultrasonically bonding a core wire bundle (stranded wire) composed of aluminum-made conductor core wires, the conductor core wires are bonded to each other while destroying oxide films on the surfaces of the conductor core wires, thereby integrating the core wire bundle (making it into a single wire). Accordingly, the conductor core wires situated in the outer peripheral part of the core wire bundle and the conductor core wires situated in the central part of the core wire bundle are contacted substantially directly with the terminal. As a result, when compared with a case where such single wire making is not performed, the overall conductivity between the core wire bundle and terminal can be enhanced by an amount corresponding to the enhanced conductivity of the central part (see, for example, the patent documents 1 to 3).

[Patent Document 1] JP-A-2009-231079
[Patent Document 2] JP-A-2011-082127
[Patent Document 3] JP-A-2016-115525

According to a related art, a bonding force provided an ultrasonic bonding method is smaller than a bonding force provided by other bonding methods (for example, by welding, by soldering or the like). Therefore, when conductor core wires are not sufficiently bonded to each other (for example, a size of an area of a bonded portion is insufficient), depending on a use environment of a terminal-equipped electric wire (for example, when thermal expansion/thermal contraction of the bonded core wires occurs repetitively because a temperature of the use environment of the terminal-equipped electric wire goes up and down), the conductor core wires cannot maintain a bonded state but a core wire bundle (bonded core wire) can be separated into multiple conductor core wires (the bonded portion can be broken, thereby removing the single wire making). In this case, oxide films are newly formed on the surfaces of the separated conductor core wires, thereby impairing the effect of the above-mentioned integration (single wire making).

On the other hand, when, in ultrasonic bonding processing, the core wire bundle is compressed excessively in order to avoid the above-mentioned removal of the single wire making, creep deformation can occur in the bonded core wire after the terminal is crimped to the bonded core wire, whereby the bonded core wire can be partially peeled off the terminal. In this case, conductivity between the terminal and bonded core wire can be lowered by an amount corresponding to a reduction in the contact area between the terminal and bonded core wire.

SUMMARY

One or more embodiments provide a method for manufacturing a terminal-equipped electric wire which can enhance and maintain as much as possible the conductivity of a terminal-equipped electric wire comprising a bonded core wire composed of multiple mutually bonded conductor core wires and a terminal crimped to the bonded core wire.

In an aspect (1), a manufacturing method for a terminal-equipped electric wire in which a terminal is crimped to an electric wire including a core wire bundle bundled by a plurality of conductor core wires, the manufacturing method comprising:

ultrasonically bonding the core wire bundle so as to form a bonded core wire in which the plurality of conductor core wires are bonded to each other; and crimping the terminal to the bonded core wire, wherein the bonded core wire s formed so that a clearance ratio which is a percentage of a clearance area in which the conductor core wires do not exist to a whole area surrounded by an outer periphery of the bonded core wire is larger than 3 and equal to or less than 15 ($3<\text{clearance ratio}\leq 15$) in a section view orthogonal to an axis of the bonded core wire.

In an aspect (2), the manufacturing method for the terminal-equipped electric wire according to the aspect (1), wherein the clearance ratio is a percentage of a clearance area of the bonded core wire to a whole area when an outer peripheral shape of the bonded core wire in the section view is approximated to a polyclon.

In an aspect (3) the manufacturing method for the terminal-equipped electric wire according to the aspect (1) or (2), wherein the plurality of conductor core wires are made of aluminum or aluminum alloy.

According to the aspect (1), the results of an experiment conducted by the inventor on the electric resistance value of the crimped portion where the terminal is crimped to the bonded core wire have clarified that, when the clearance ratio is 15 or smaller (clearance ratio≤15) the electric resistance value of the crimped portion after subjected to a thermal shock test (for example, the Accelerated Environment Exposure Test of the US standard USCAR-21 stipulated by SAE International) falls within a predetermined reference range. Further, the results of another experiment conducted separately by the inventor have clarified that, when the clearance ratio is larger than 3 (clearance ratio>3), in the crimped portion, creep deformation is hard to occur in the bonded core wire and a phenomenon in which the bonded core is peeled off the terminal is hard to occur.

Thus, the terminal-equipped electric wire manufacturing method of this configuration can enhance and maintain as much as possible the conductivity of the terminal-equipped electric wire comprising the bonded core wire composed of the mutually bonded multiple conductor core wires and the terminal crimped to the bonded core wire.

According to the aspect (2), since the outer peripheral shape of the section of the bonded core wire is approximated to a polygon (for example, when the section shape of the bonding processing room of an ultrasonic bonding apparatus is square, such section is approximated to a simple square), calculation of the clearance ratio can be facilitated. Here, even when such approximation is carried out, the fine irregular shape of the outer periphery of the bonded core wire, normally, has no substantial effect on the calculation result of the clearance ratio. Thus, this configuration can further facilitate the enforcement of the manufacturing method of the aspect (1).

According to the aspect (3), when crimping a terminal to the conductor core wires (aluminum wires) made of aluminum or aluminum alloy in which the insulation property of an oxide film formed on the surface thereof is larger than that of generally used conductor core wires (copper wires) made of copper, there can be obtained the above-mentioned effects.

According to one or more embodiments, it is possible to provide a terminal-equipped electric wire manufacturing method which can enhance and maintain as much as possible the conductivity of a terminal-equipped electric wire comprising a bonded core wire composed of mutually bonded multiple conductor core wires and a terminal crimped to the bonded core wire.

The invention has been briefly described heretofore. When the mode for carrying out the invention is read through with reference to the accompanying drawings, the details of the invention will be further clarified.

BRIEF DESCRIPTION OF THE DRAWINGS

FIGS. 1A to 1D are respectively perspective views of the end of the electric wire.

FIG. 2A is a front view of the end of the electric wire. FIG. 2B is a front view of the end of the electric wire in which a bonded core wire is formed. FIG. 2C is a front view of the bonded core wire.

FIG. 5A is a front view of the terminal crimping machine in which a terminal and the bonded core wires of the electric wire are arranged, and FIG. 5B is a front view of an anvil in which the terminal and the bonded core wires of the electric wire are arranged.

DETAILED DESCRIPTION

Embodiment

With reference to the drawings, description is given below of a manufacturing method for a terminal-equipped electric wire according to an embodiment of the invention.

Figure 1A:
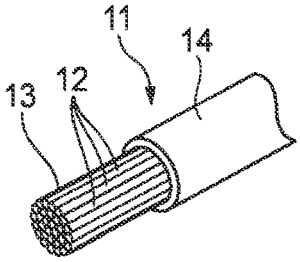
FIGS. 1A to 1D explain the outline of a manufacturing method for a terminal-equipped electric wire according to an embodiment.
Figure 1B:
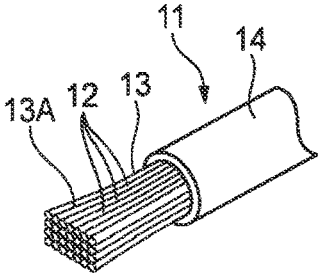
Figure 1C:
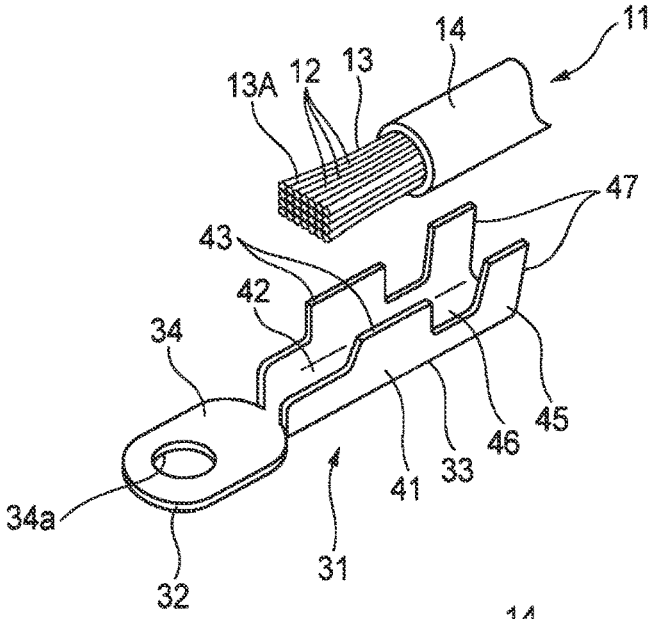
Figure 1D:
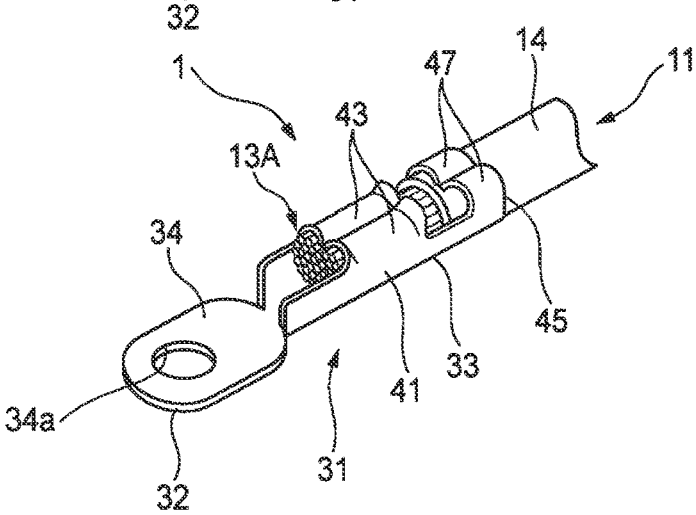

In a manufacturing method for a terminal-equipped electric wire according to the embodiment, firstly, as shown in FIG. 1A, an insulation coating 14 of an electric wire 11 is peeled off to expose a core wire bundle 13 composed of multiple conductor core wires 12. Next, as shown in FIG. 1B, ultrasonic bonding processing (the details of which are described later) is applied to the core wire bundle 13 to form a bonded core wire 13A in which adjacent conductor core wires 12 are bonded to each other. Next, as shown in FIG. 1C, the bonded core wire 13A is arranged in a predetermined portion of a terminal 31 and, after then, as shown in FIG. 1D, the terminal 31 is crimped to the bonded core wire 13A (and its adjacent insulation coating 14), thereby manufacturing a terminal-equipped electric wire 1.

Figure 2A:
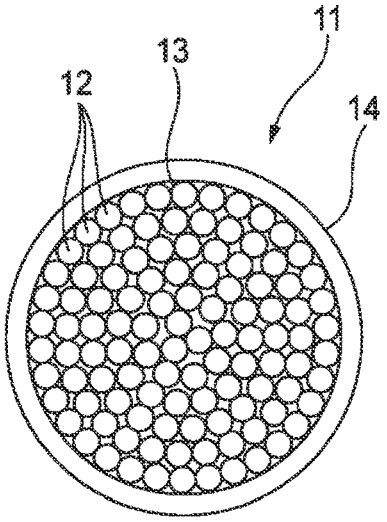
FIGS. 2A to 2C explain an electric wire to which a terminal is crimped.

As shown in FIGS. 1A and 2A, the electric wire 11 is configured such that the outer periphery of the core wire bundle 13 composed of a plurality of bundled conductor core wires 12 is covered with the insulation coating 14. In this embodiment, each conductor core wire 12 is a non-plated wire made of aluminum or aluminum alloy. In other words, the electric wire 11 is a so-called aluminum electric wire or aluminum alloy electric wire.

Figure 2B:
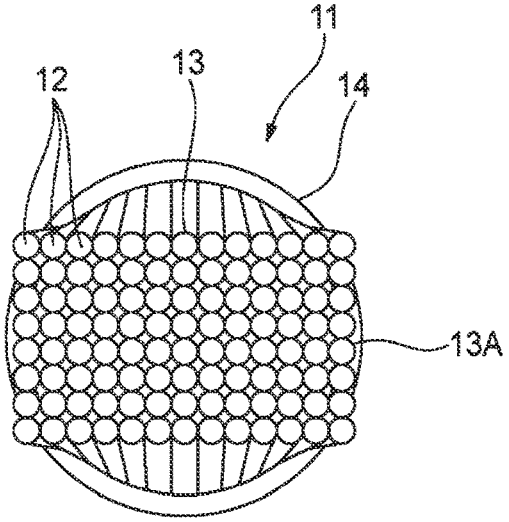

As shown in FIGS. 1B and 2B, the bonded core wire 13A composed of the ultrasonically bonded core wire bundle 13 of the electric wire 11 has a rectangular (in this embodiment, an oval) shape in its section orthogonal to its axis. In the bonded core wire 13A, the multiple conductor core wires 12 constituting the core wire bundle 13 are bonded to each other by ultrasonic vibrations.

Figure 3:
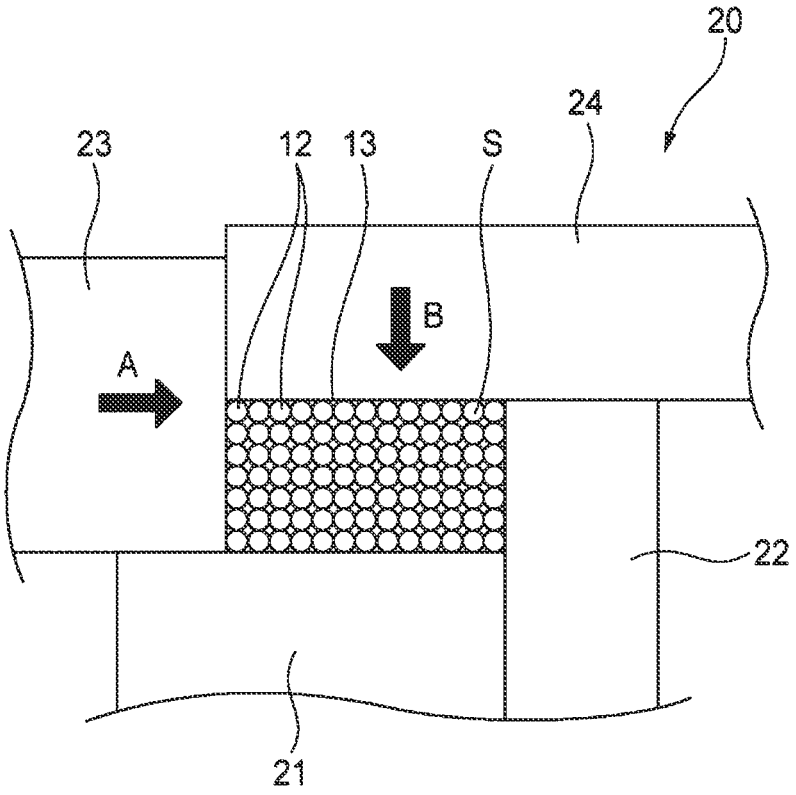
FIG. 3 is a schematic view of an ultrasonic bonding machine for ultrasonically bonding a core wire bundle.

As shown in FIG. 3, an ultrasonic bonding machine 20 for ultrasonically bonding the core wire bundle 13 of the electric wire 11 includes a horn 21, an anvil plate 22, a gliding jaw 23, and an anvil 24. The horn 21 can be ultrasonically oscillated in the back-and-forth direction of the page of FIG. 3 by an ultrasonic oscillator. In the upper surface (surface to be contacted with the core wire bundle 13) of the horn 21, there is formed a knurl (not shown) composed of multiple ridges extending orthogonally to the oscillation direction, thereby suppressing slippage between the upper surface of the horn 21 and core wire bundle 13. In the ultrasonic bonding machine 20, a space, which is defined by the horn 21, anvil plate 22, gliding jaw 23 and anvil 24 and has a rectangular cross section, is used as a bonding processing room S, while the conductor core wires 12 of the core wire bundle 13 arranged within the bonding processing room S are ultrasonically bonded to each other.

The anvil plate 22 is arranged in the lateral portion of the horn 21. The gliding jaw 23 is arranged on the upper surface of the horn 21 at a position opposed to the anvil plate 22 and is movable towards or away from, the anvil plate 22. In FIG. 3, the gliding jaw 23 is moving in a direction shown by the arrow A to thereby press against the core wire bundle 13 in this direction.

The anvil 24 is arranged above the horn 21 and anvil plate 22 and, when it moves up and down, it is movable towards or away from the horn 21. In FIG. 3, the anvil 21 is moving in a direction shown by the arrow B to thereby press against the core wire bundle 13 in this direction.

The ultrasonic bonding machine 20, by moving the gliding jaw 23 and anvil 24 in the above-mentioned manner, can freely change the width and height of the bonding processing room S (and thus the width and height of the bonded core wire 13A produced by bonding the core wire bundle 13). By adjusting the width and height of the bonding processing room S in this manner, a bonded core wire 13A having a desired clearance ratio (the details of which are described later) can be formed.

Referring again to FIGS. 1A to 1D, as shown in FIG. 1C, the terminal 31 includes an electric connection part 32 and a crimping connection part 33. The terminal 31 is formed, for example, by pressing a metal plate made of conductive metal material such as copper or copper alloy. Thus, in this embodiment, the thickness of the terminal 31 is substantially the same at any point.

The electric connection part 32 includes a flat plate-shaped connection plate section 34 having a connection hole 34*a*. The connection plate section 34 can be electrically connected to a terminal block of a connecting equipment, for example, by inserting a fastening bolt through the connection hole 34*a* to fasten the connection plate section 34 to the terminal block.

The crimping connection part 33 includes, in order from the side of the electric connection part 32, a conductor crimping portion 41 and a coating crimping portion 45. The conductor crimping section 41 has a base section 42 and a pair of conductor crimping pieces 43 (crimping pieces) formed on the two lateral sides of the base section 42. On the base section 42, there is placed the bonded core wire 13A. The conductor crimping pieces 43 extend from the base section 42 so as to sandwich the bonded core wire 13A. By curving (crimping) the paired conductor crimping pieces 43 inwardly, the conductor crimping portion 41 is crimped to the bonded core wire 13A of the electric wire 11. This brings the terminal 31 into conduction connection with the core wire bundle 13 of the electric wire 11.

The coating crimping portion 45 includes a base section 46 and a pair of coating crimping pieces 47 formed on the two lateral sides of the base section 46. The base section 46 of the coating crimping portion 45 extends from the base section 42 of the conductor crimping portion 41. On the base section 46, there is placed the insulation coating 14 of the electric wire 11. The coating crimping pieces 47 extend from the base ction 46 so as to sandwich the insulation coating 14 portion of the electric wire 11. By curving (crimping) the paired coating crimping pieces 47 inwardly, the coating crimping portion 45 is crimped and fixed to the insulation coating 14 portion of the electric wire 11.

Figure 4:
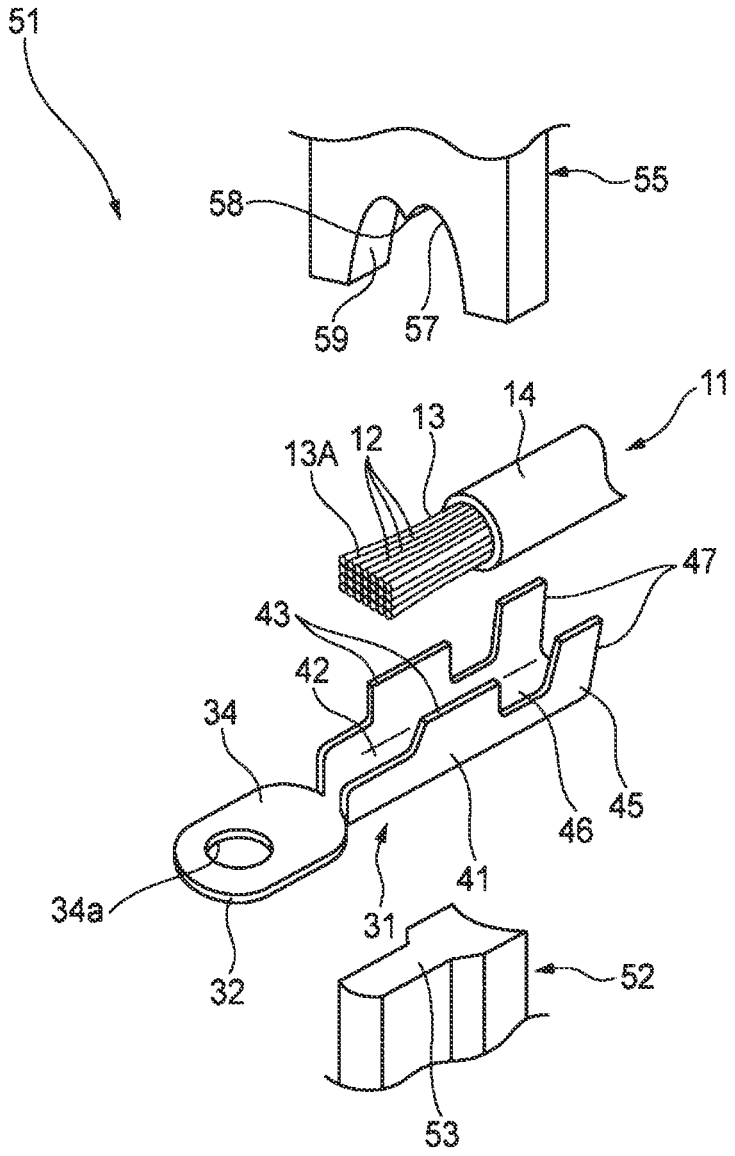
FIG. 4 is a perspective view of a terminal crimping machine for crimping a terminal to an electric wire and electric wires etc.
Figure 5A:
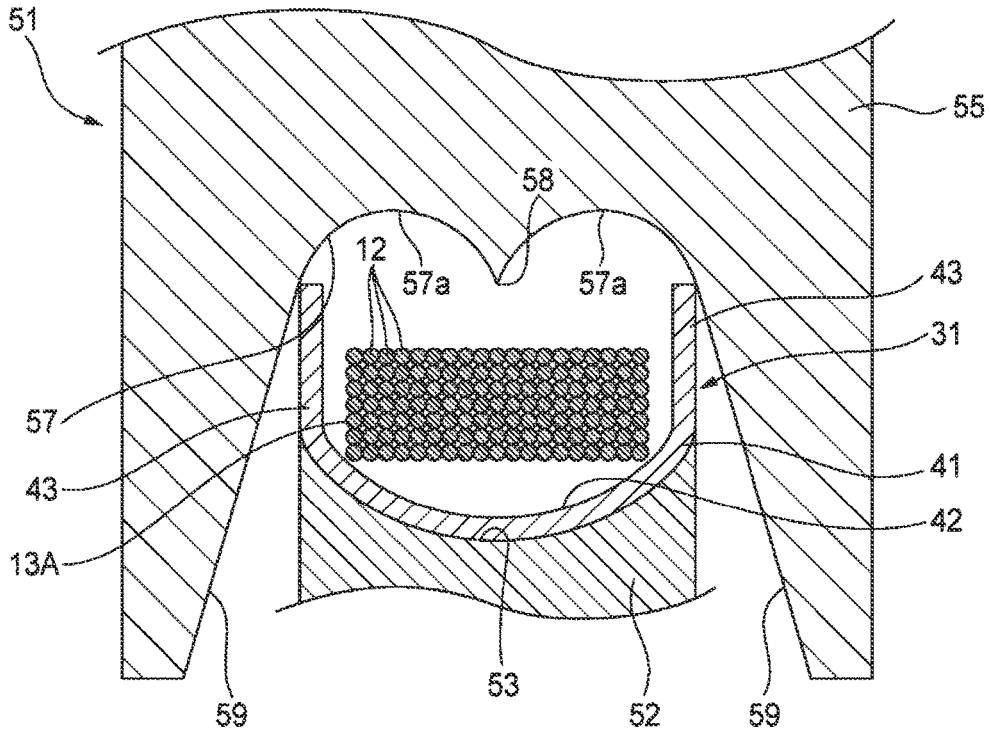
FIGS. 5A and 5B explain a method for crimping a terminal using the terminal crimping machine.
Figure 5B:
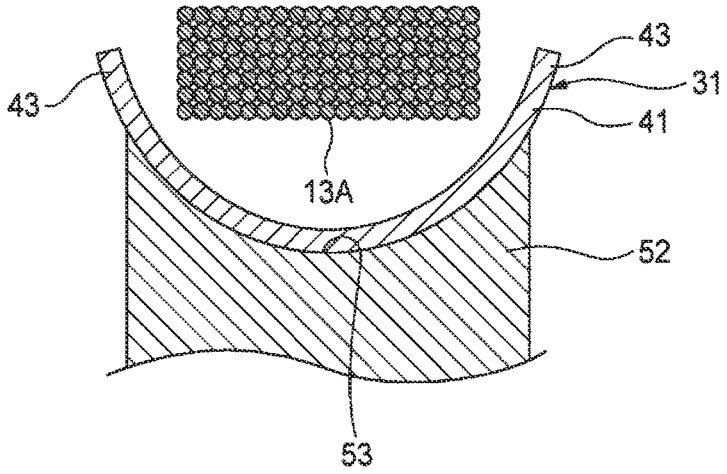

As shown in FIG. 4 and FIGS. 5A and 5B, the terminal 31 is crimped to the electric wire 11 by a terminal crimping machine 51. The terminal crimping machine 51 includes an anvil 52 and a crimper 55. The anvil 52 is arranged below the terminal 31 and bonded core wire 13A, while the crimper 55 is arranged above the terminal 31 and bonded core wire 13A. The crimper 55 is movable in the vertical direction relative to the anvil 52.

The anvil 52 has, in its top part, a support surface 53 which is curved so as to be recessed downward. In crimping the terminal 31, the support surface 53 supports the base section 46 of the terminal 31. Specifically, the outer surface of the base section 42 of the terminal 31 is contacted with the support surface 53.

The crimper 55 includes, in its central portion in the width direction, an arch groove 57 having a chevron portion 58 projecting toward the anvil 52. The arch groove 57 is constituted of two arc-shaped surfaces 57*a* formed on the two sides of the chevron portion 58. Each arc-shaped surface 57*a* is an arc-shaped convex surface projecting away from the support surface 53. The crimper 55 has two guide inclined surfaces 59. The guide inclined surfaces 59 are inclined so as to be gradually spaced away from each other toward the anvil 52. The guide inclined surfaces 59 are formed to continue with the two ends of the arch groove 57.

Next, description is given specifically of a manufacturing method for a terminal-equipped electric wire 1 according to this embodiment.

(Terminal Processing Step)

As shown in FIG. 1A, the insulation coating 14 existing in the end of the electric wire 11 is peeled off to expose the core wire bundle 13 composed of the bundled conductor core wires 12 by a predetermined length. The predetermined length of the core wire bundle 13 to be exposed may be a length sufficient to crimp the terminal 31.

(Ultrasonic Bonding Step)

Figure 2C:
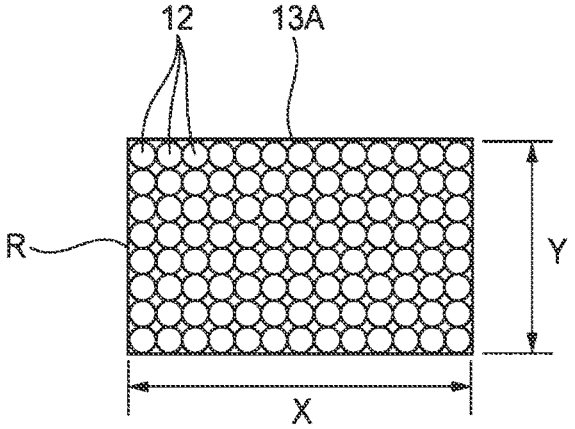

As shown in FIG. 1B, the core wire bundle 13 exposed in the end of the electric wire 11 is ultrasonically bonded to thereby form the bonded core wire 13A in which the multiple conductor core wires 12 are bonded to each other. Specifically, as shown in FIG. 3, the exposed core wire bundle 13 is arranged in the bonding processing room S of the ultrasonic bonding machine 20, the gliding jaw 23 is moved in a direction toward the anvil plate 22 (in the arrow A direction shown in FIG. 3) and the anvil 24 is moved in a direction toward the horn 21 (in the arrow B direction shown in FIG. 3), and the core wire bundle 13 in the bonding processing room S is pressed from both sides and from above and below. And, in this state, the horn is ultrasonically vibrated. Thus, in the bonding processing room S, the conductor core wires 12 are bonded to each other while oxide films formed on the surfaces of the conductor core wires 12 are being destroyed. Accordingly, as shown in FIG. 2C, there is formed a rectangular bonded core wire 13A with a section shape having a width X and a height Y. In the thus-formed bonded wire core 13A, the conductor core wires 12 are bonded into an integral wire (a single wire), whereby the conductor core wires 12 are conducted to each other in a satisfactory conduction state.

(Terminal Crimping Step)

As shown in FIG. 1D, the terminal 31 is crimped to the bonded core wire 13A using the terminal crimping machine 51. Specifically, firstly, as shown in FIG. 5B, the terminal 31 is placed on and supported by the support surface 53 of the anvil 52 and the end of the electric wire 11 is arranged on the terminal 31.

After the end of the electric wire 11 is arranged on the terminal 31, in order to crimp the terminal 31 to the electric wire 11, the crimper 55 is lowered to bring it close to the anvil 52. At this time, the ends of the conductor crimping pieces 43 of the terminal 31 respectively spread on both lateral sides are brought into contact with the guide inclined surfaces 59 of the crimper 55. Thus, the conductor crimping pieces 43 are deformed in directions approaching each other along the guide inclined surfaces 59.

When the crimper 55 is lowered further to bring it close to the anvil 52, in the terminal 31, the conductor crimping pieces 43 reach the arch groove 57 (see FIG. 5A) and, from this state, the conductor crimping pieces 43 are pushed by the arch groove 57 in directions approaching each other and are deformed so as to be curved (wound) inward.

Figure 6:
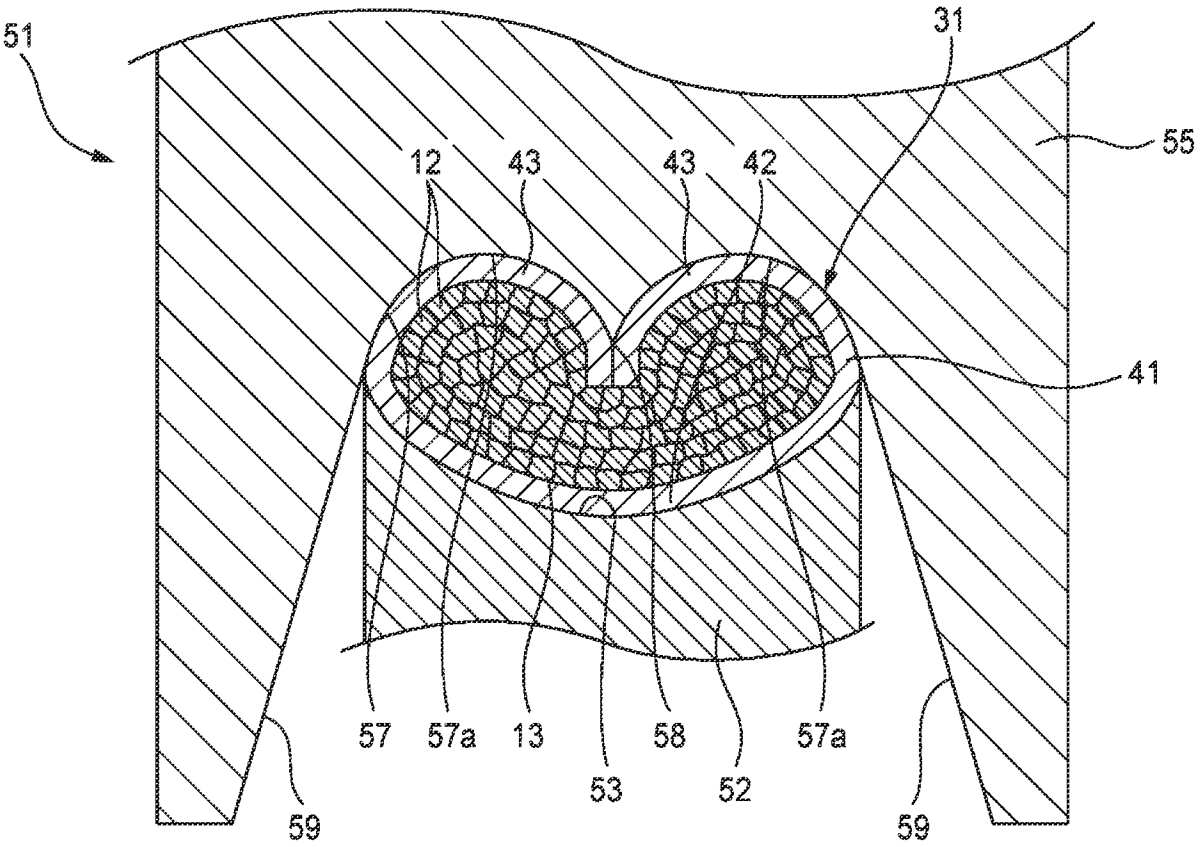
FIG. 6 is a front view of the terminal crimping machine in a state where it has crimped the terminal to the electric wire.
Figure 7:
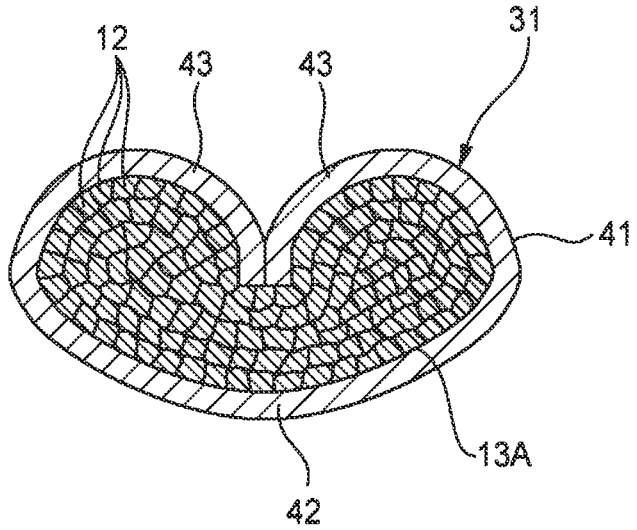
FIG. 7 is a section view of the crimped portion of a terminal-equipped electric wire where the terminal is crimped to the electric wire.

After then, as shown in FIG. 6, the anvil 52 and crimper 55 are caused to approach each other until a crimping completion state in which the shape of the space sandwiched by the support surface 53 and arc-shaped surface 57*a* becomes a predetermined crimped shape. At this time, the conductor crimping portion 41 of the terminal 31 is sandwiched by the anvil 52 and crimper 55 and is pressed against the bonded core wire 13A. Thus, as shown in FIG. 7, the terminal 31 is firmly crimped to the core wire bundle 13 (bonded core wire 13A) with no clearance, whereby the terminal 31 is securely conducted to the core wire bundle 13 of the electric wire 11.

Here, in the terminal crimping step, the coating crimping pieces 47 of the terminal 31 are crimped by an anvil and a crimper (neither of which are shown) provided on the terminal crimping machine 51, whereby the coating crimping portion 45 of the terminal 31 is crimped and fixed to the insulation coating 14 portion of the electric wire 11.

(Proper Range of Clearance Ratio in Bonded Core Wire after Ultrasonic Bonding Step)

As described above, in the ultrasonic bonding step, while pressing the core wire bundle 13 within the bonding processing room S from both sides and from above and below, ultrasonic vibrations are applied to the core wire bundle 13. As the degree of pressing on the core wire bundle 13 in the ultrasonic bonding step increases, the ratio of a portion (a clearance portion) where the conductor core wires 12 in the section of the bonded core wire 13A (the section provided when the bonded core wire 13A is cut by a plane orthogonal to the axis of the bonded core wire 13A) after the ultrasonic bonding step do not exist decreases. In the following description, with respect to the above section after the ultrasonic bonding step, a percentage of the area of the clearance portion to the area of the whole portion surrounded by the outer periphery of this section is defined as a [clearance ratio] (%). The clearance ratio can be adjusted arbitrarily by adjusting the degree of pressing of the core wire bundle 13 in the ultrasonic bonding step.

Strictly speaking, the area of the whole portion of the section of the bonded core wire 13A means the area of a portion surrounded by the outer peripheral shape of the bonded core wire 13A shown in FIG. 2C (that is, a contour shape obtained when fine irregular shapes (arc-like shapes) defined by the respective outer peripheries of the multiple conductor core wires 12 situated in the outer peripheral portion of the bonded core wire 13A are connected together in order). However, in order to facilitate the calculation of the clearance ratio, an approximate area obtained when the outer peripheral shape of the bonded core wire 13A is approximated to a polygon (in the example shown in FIG. 2C, the area of a rectangle R) may also be employed as the area of the whole portion of the section of the bonded core wire 13A. Here, the area of the whole portion of the section of the bonded core wire 13A and the area of the clearance portion can be obtained, for example, by applying a known image processing to an image obtained by photographing the section of the bonded core wire 13A (see FIG. 2C).

The inventor has found that, in the case of the clearance ratio (%) larger than 3 and equal to or smaller than 15 ($3<$clearance ratio$\leq 15$), even when the terminal-equipped electric wire 1 after subjected to the ultrasonic bonding step is placed under a severe use environment, the electric resistance value of a crimped portion (which is hereinafter called [crimped portion resistance]) between the bonded core wire 13A and terminal 31 is hard to increase when compared with a case where the clearance ratio does not belong to this range. Hereinafter, two experiments conducted by the inventor in relation to this point are described.

In the first experiment (thermal shock test), for multiple samples having different clearance ratios (%), crimped portion resistances (mΩ) before and after the thermal shock test (the test according to the Accelerated Environment Exposure Test of the US standard USCAR-21 stipulated by SAE International) were measured. As the crimped portion resistance, specifically, the electric resistance value between a predetermined location of the connection plate section 34 of the terminal 31 in the terminal-equipped electric wire 1 (see FIG. 1D) and a predetermined location of the bonded core wire 13A was measured. The results of this test are shown in FIG. 8.

In this test, actually, for multiple (specifically, ten) samples having clearance ratios of less than 10%, multiple (specifically, ten) samples having clearance ratios of 10% to 15%, and multiple (specifically, ten) samples having clearance ratios of larger than 15%, electric resistance values were measured respectively. In FIG. 8, for the sample groups respectively having clearance ratios of [less than 10%], [10% to 15%] and [larger than 15%], a solid line in an upper stage, a rhombus mark in an intermediate stage and a solid line in a lower stage respectively show the maximum values, average values and minimum values of the crimped portion resistances measured. Further, the left side (thin line) maximum values, average values and minimum values respectively show values before the above-mentioned thermal shock test, whereas the right side (thick line) maximum values, average values and minimum values respectively show values after the thermal shock test. In this test, the accepted reference range of the crimped portion resistance was the range of 0.05 mΩ or less (see broken lines of FIG. 8).

Figure 8:
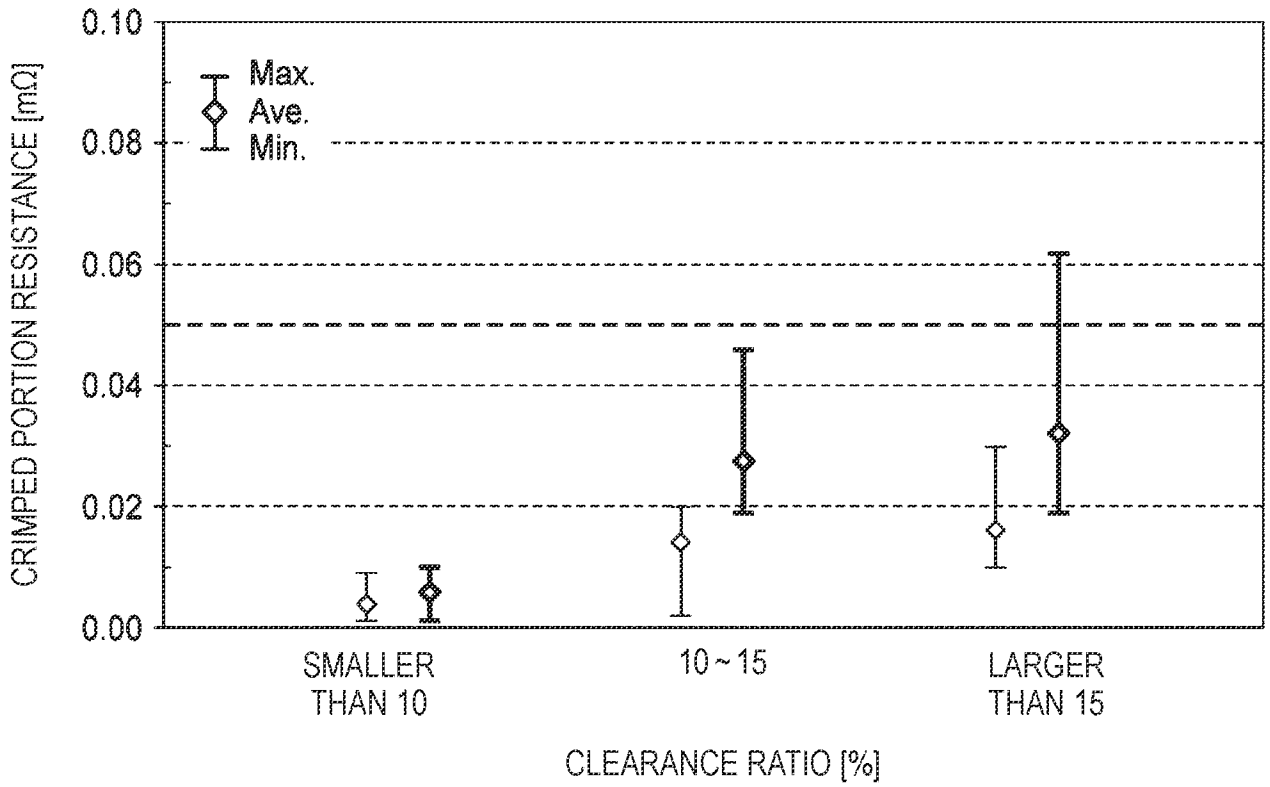
FIG. 8 is a graph which comparatively shows the relationships between a clearance ratio and electric resistance value in a crimped portion before and after a thermal shock test.

As shown in FIG. 8, it was clarified that, the larger the clearance ratio is, the more the degree of increase in the crimped portion resistance after the thermal shock test with respect to the crimped portion resistance before the thermal shock test is. And, it was clarified that, for the crimped portion resistance after subjected to the ultrasonic bonding step, when the clearance ratio is 15% or less (clearance ratio$\leq 15$), even after the thermal shock test, the crimped portion resistance falls within the accepted reference range.

The above result may be based on the fact that, when the clearance ratio is 15% or less, a phenomenon, in which the core wire bundle 13 (bonded core wire 13A) is separated into the multiple conductor core wires 12 due to the thermal expansion/thermal contraction of the bonded core wire 13A caused the up and down of the temperature of the use environment, is hard to occur. When the core wire bundle 13 (bonded core wire 13A) is hard to be separated into the multiple conductor core wires 12, a phenomenon, in which oxide films occur again on the surfaces of the separated conductor core wires 12, is hard to occur. As a result, the effect of the above-mentioned integration (single wire making) is hard to be impaired.

Further, in the second experiment (creep test), multiple samples having different clearance ratios (%) were observed as to whether, after elapse of a predetermined period (a period assuming a normal use time) after the terminal 31 was crimped to the bonded core wire 13A, a clearance occurs or not between the bonded core wire 13A and terminal 31 (in other words, whether creep deformation occurs or not). The test, result has clarified that, when the clearance ratio of the bonded core wire 13A is 3% or less, after this test, a phenomenon (creep deformation) in which, as shown in FIG. 9, a portion of the bonded core wire 13A is peeled off the terminal 31 to thereby produce a clearance P, is easy to occur between the terminal 31 and bonded core wire 13A; and that, when the clearance ratio is larger than 3%, even after this test, such a peel-off phenomenon as shown in FIG. 9 is hard to occur.

Figure 9:
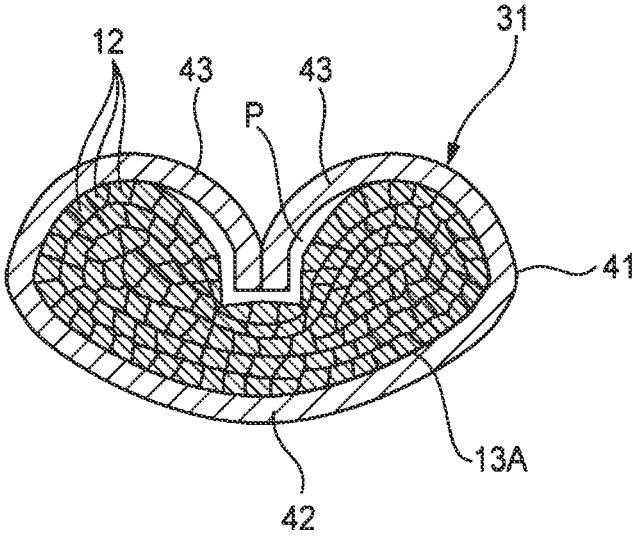
FIG. 9 shows a state where a portion of the bonded core wire is peeled off from the terminal due to occurrence of creep deformation in the bonded core wire, correspondingly to FIG. 7.

When such a peel-off phenomenon as shown in FIG. 9 occurs, the crimped portion resistance increases by an amount corresponding to the clearance P. From the viewpoint of avoiding this increase in the crimped portion resistance, it is desired to prevent this peel-off phenomenon.

The results of the above-mentioned two tests clarify that, in order to suppress an increase in the crimped portion resistance as much as possible, preferably, the clearance ratio of the bonded core wire 13A may be larger than 3 and equal to or less than 15.

As described above, according to a manufacturing method for a terminal-equipped electric wire 1 according to this embodiment, since the clearance ratio of the bonded core wire 13A is larger than 3 and equal to or less than 15 (3<clearance ratio≤15), the conductivity of the terminal-equipped electric wire 1 comprising the bonded core wire 13A composed of the multiple mutually bonded conductor core wires 12 and the terminal 31 crimped to the bonded core wire 13A can be enhanced and maintained as much as possible.

Other Embodiment

Here, the invention is not limited to the above embodiment but can be variously modified and improved without departing from the range of the invention. Also, the materials, shapes, dimensions, number, arrangement locations etc. of the respective composing elements of the above embodiment are arbitrary but not limitative so long as they can attain the invention.

For example, as the electric wire 11, instead of the aluminum electric wire or aluminum alloy electric wire, there may be used an electric wire (copper wire) in which conductor core wires 12 are made of copper or copper alloy. Further, as the terminal 31, instead of the terminal made of copper or copper alloy, there may be used a terminal made of aluminum or aluminum alloy.

Figure 10A:
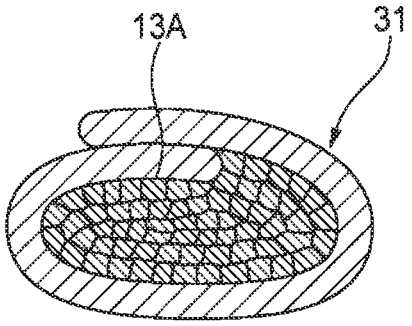
FIGS. 10A to 10E are section views of various variations of the shape of the crimped portions of a terminal-equipped electric wire according to other embodiments, respectively corresponding to FIG. 7.
Figure 10B:
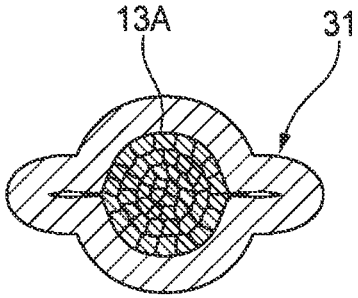
Figure 10C:
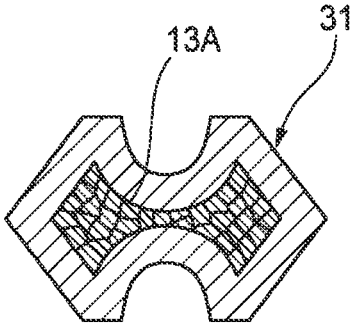
Figure 10D:
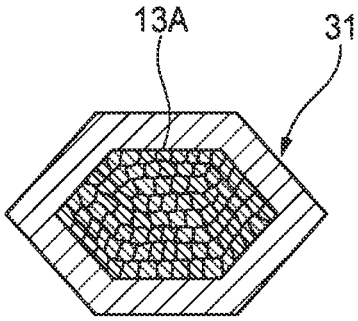
Figure 10E:
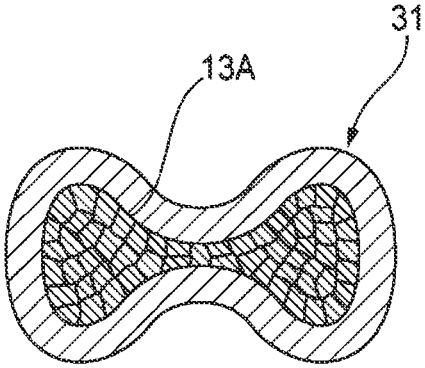

Moreover, for example, when crimping the terminal 31 to the bonded core wire 13A after subjected to ultrasonic bonding processing, the section of the crimped portion is not limited to any particular shape. Specifically, as shown in FIG. 10A, the terminal 31 may be crimped so as to surround the outer peripheral surface of the bonded core wire 13A. In addition, as shown in FIGS. 10B to 10E, in a state where the bonded core wire 13A is inserted into a tubular terminal 31, they may be crimped so as to have various section shapes. Here, the inventor has confirmed that, without considering the section shape of the crimped portion, when the clearance ratio of the bonded core wire 13A is in the above-mentioned range (3<clearance ratio≤15), the effect described in the above embodiment can be obtained.

Here, the characteristics of the above embodiment of a manufacturing method for a terminal-equipped electric wire according to the invention are briefly listed in the following configurations (1) to (3).

(1) manufacturing method for a terminal-equipped electric wire (1) in which a terminal (31) is crimped to an electric wire (11) including a core wire bundle (13) bundled by a plurality of conductor core wires (12), the manufacturing method comprising:

ultrasonically bonding the core wire bundle (FIG. 3) so as to form a bonded core wire (13A) in which the plurality of conductor core wires are bonded to each other; and crimping the terminal to the bonded core wire (FIG. 4), wherein the bonded core wire (13A) is formed so that a clearance ratio which is a percentage of a clearance area in which the conductor core wires do not exist to a whole area surrounded by an outer periphery of the bonded core wire is larger than 3 and equal to or less than 15 (3<clearance ratio≤15) in a section view orthogonal to an axis of the bonded core wire (13A).

(2) The terminal-equipped electric wire manufacturing method according to the above configuration (1), wherein the clearance ratio is a percentage of a clearance area of the bonded core wire to a whole area (rectangle R) when an outer peripheral shape of the bonded core wire (13A) in the section view is approximated to a polygon.

(3) The terminal-equipped electric wire manufacturing method according to the above configuration (1) or (2), wherein the plurality of conductor core wires (12) are made of aluminum or aluminum alloy.

DESCRIPTION OF REFERENCE NUMERALS AND SIGNS

1: Terminal-equipped electric wire
11: Electric wire
12: Conductor core wire
13: Core wire bundle
13A: Bonded core wire
31: Terminal

What is claimed is:

1. A manufacturing method for a terminal-equipped electric wire in which a terminal is crimped to an electric wire including a core wire bundle bundled by a plurality of conductor core wires, the manufacturing method comprising:

ultrasonically bonding the core wire bundle so as to form a bonded core wire in which the plurality of conductor core wires are bonded to each other; and crimping the terminal to the bonded core wire, wherein the bonded core wire is formed so that a clearance ratio, expressed as a percentage, is a ratio of a clearance area divided by a whole area that is larger than 3 and equal to or less than 15, in a section view orthogonal to an axis of the bonded core wire; wherein the clearance area is between the bonded core wire and a portion of the terminal, and the whole area is the bonded core wire surrounded by an outer periphery of the bonded core wire.

2. The manufacturing method for the terminal-equipped electric wire according to claim 1, wherein an outer peripheral shape of the bonded core wire in the section view is approximated to be a polygon.

3. The manufacturing method for the terminal-equipped electric wire according to claim 1, wherein the plurality of conductor core wires are made of aluminum or aluminum alloy.

4. The manufacturing method for the terminal-equipped electric wire according to claim 1, wherein the ultrasonically bonding includes destroying oxide films formed on surfaces of the plurality of conductor core wires and bonding the plurality of conductor core wires.

* * * * *